United States Patent [19]

Stahlecker et al.

[11] Patent Number: 4,459,801

[45] Date of Patent: Jul. 17, 1984

[54] FEEDING AND OPENING DEVICE FOR OPEN-END SPINNING UNITS WITH A SEPARATION OPENING FOR IMPURITIES

[75] Inventors: Fritz Stahlecker, Josef-Neidhart-Strasse 18, Bad Überkingen, Fed. Rep. of Germany; Kurt Lang, Lauterstein, Fed. Rep. of Germany

[73] Assignees: Fritz Stahlecker; Hans Stahlecker, both of Fed. Rep. of Germany

[21] Appl. No.: 392,596

[22] Filed: Jun. 28, 1982

[30] Foreign Application Priority Data

Jul. 11, 1981 [DE] Fed. Rep. of Germany ..... 3127415

[51] Int. Cl.[3] ..... D01H 1/12

[52] U.S. Cl. ..... 57/412

[58] Field of Search ..... 57/408, 412; 19/97, 19/115, 219

[56] References Cited

U.S. PATENT DOCUMENTS

| | | | |
|---|---|---|---|
| 1,662,308 | 3/1928 | Gegauf | 19/219 |
| 3,439,488 | 4/1969 | Bucil et al. | 57/412 |
| 3,828,539 | 8/1974 | Croasdale et al. | 57/412 |
| 3,938,310 | 2/1976 | Didek et al. | 57/412 |
| 4,109,453 | 8/1978 | Kobayshi et al. | 57/412 |

*Primary Examiner*—Donald Watkins

*Attorney, Agent, or Firm*—Craig & Burns

[57] ABSTRACT

A feeding and opening device for open-end spinning units comprises a feeding roller and a feed table resiliently urged against the feeding roller for feeding a sliver to an opening roller, as well as at least one mechanical supporting element that is located at a spacing from a guide edge of the feed table, while leaving a free space that is open towards the atmosphere between the guide edge and the at least one mechanical supporting element. In accordance with preferred embodiments, the supporting element may be formed of at least one strip located essentially in parallel to an axis of rotation of the opening roller, or at least one row of needles arranged with their free ends directed towards the opening roller.

20 Claims, 10 Drawing Figures

FEEDING AND OPENING DEVICE FOR OPEN-END SPINNING UNITS WITH A SEPARATION OPENING FOR IMPURITIES

BACKGROUND AND SUMMARY OF THE INVENTION

The invention concerns a feeding and opening device for open-end spinning units with a feeding roller and a feed table resiliently urged against this roller for feeding a sliver to an opening roller, a separation opening for impurities being arranged in a peripheral region of the opening roller, the separation opening extending from a guide surface for directing away the impurities, directly up to a guiding edge of the feed table, wherein a supporting means for supporting the sliver fed to the opening roller is provided in the zone of the separation opening.

It is known (German Pat. No. 1,914,115) to support the introduced sliver, in the zone after the guiding edge of the feed table, by means of a supporting surface encompassing the opening roller, over the full length of a fiber tuft being formed, and additionally, to add, after this supporting surface, a guide surface likewise narrowly encompassing the opening roller; by means of this guide surface, after opening and separating, the fibers and the impurities are guided over a certain path length wherein the dirt is centrifuged. In this type of structure, acceleration in the peripheral direction of the opening roller is imparted not only to the fibers, but also to the impurities.

It is, furthermore, conventional (German Pat. No. 2,440,224) to enlarge the separation opening and extend same to the guiding edge of the feed table so that the thus-formed fiber tuft, constituted by the fibers of the sliver still hemmed in by the feeding device, projects into the separation opening. To prevent the freely suspended fiber tuft from moving away from the fitting of the opening roller, the provision is made to blow air radially to the opening roller in the zone of the fiber tuft, which air supports the fiber tuft. It is very difficult to uniformly meter this air supply at all spinning stations. Therefore, in a practically utilized construction, the feed table is equipped with a closed supporting surface extending tangentially to the opening roller, the fiber tuft projecting past this surface so that the beating out and flying away of the dirt are not impeded. This rigid supporting of the sliver, in the region where the fitting of the opening roller engages the sliver, increases, however, the danger that the fibers are damaged mechanically. Furthermore, all of these designs exhibit the basic drawback that the fiber tuft tends to yield in the axial direction of the opening roller and tends to place itself between the fitting elements, which are engaged in a spiral on the opening roller, so that opening is impaired.

The present invention, therefore, has a principal object of improving a device of the type discussed above, with respect to sliver support, in such a way that the danger of fiber damage is averted. This object has been attained, in accordance with preferred embodiments disclosed herein, by providing, as the supporting device, one or several mechanical supporting elements that are arranged at a spacing from the guiding edge of the feed table, leaving a free space that is open to the atmosphere.

It is made possible by such supporting elements to hold the sliver, in the zone of the fitting of the opening roller, in such a way that perfect opening and separation, as well as a perfect beating out of the impurities are ensured. Additionally, the free space makes it possible for the fibers of the sliver to yield, upon their impingement, in a direction away from the fitting, so that the danger of fiber damage is avoided. Since the free space is open toward the atmosphere, ingress of air is ensured, constituting a certain cushion for the yielding fibers and simultaneously loosening same somewhat.

In accordance with preferred embodiments of the invention, one or several strips are provided as the supporting element, each being arranged at a spacing from the guiding edge of the feed table, essentially in parallel to the axis of the opening roller. It is advantageous, in this connection, if one strip is oriented toward the circumference of the opening roller with a blade-like sharpened edge. It is especially advantageous herein if the edge is equipped with tooth-like profiling. By this tooth-like profiling, a lateral guidance is additionally obtained for the sliver or fiber tuft so that it cannot shift in the axial direction of the opening roller.

In another advantageous embodiment of the invention, at least one row of needles is arranged downstream of the guiding edge of the feed table, in the conveying direction of the sliver, wherein the needles are held at one end at a larger radial spacing from the circumference of the opening roller than the guiding edge of the feed table. Such needles, supporting, with a free end, the sliver or the fiber tuft, effect lateral guidance of the sliver, since the fibers can penetrate in between the needles. A fluttering of the fiber tuft is securely prevented, and effective opening is achieved.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
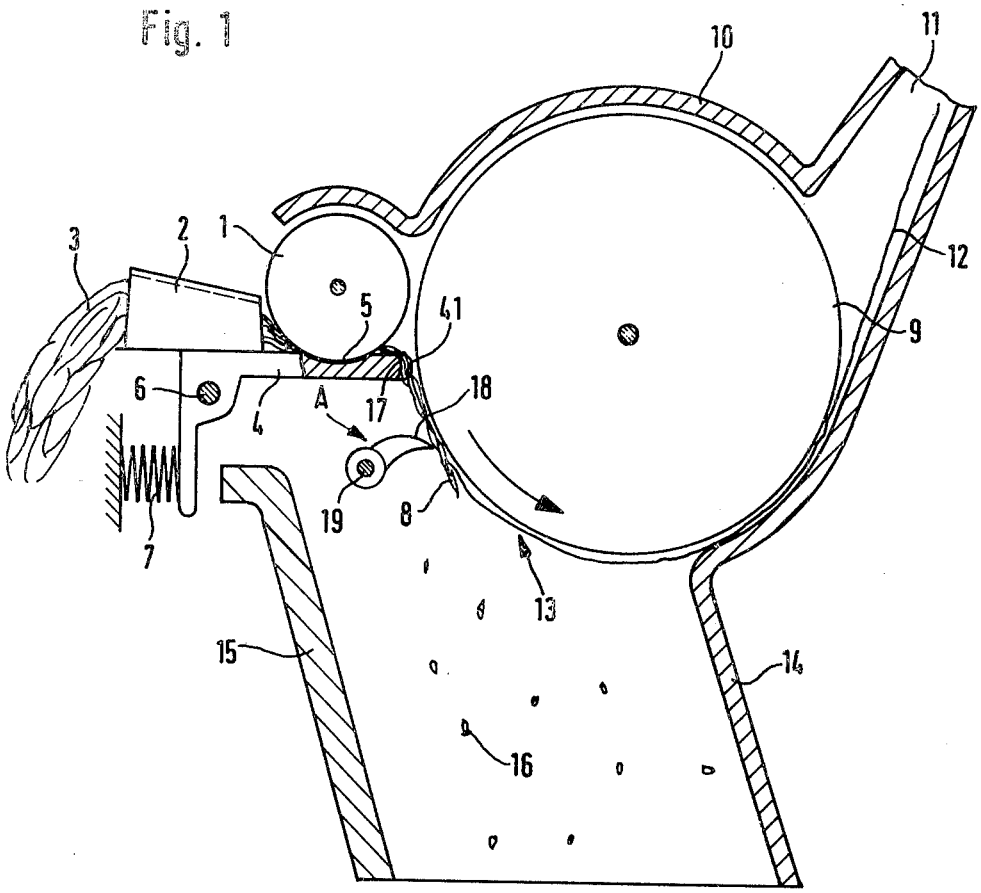
FIG. 1 shows a lateral partial sectional view of a feeding and opening device according to this invention.

The feeding and opening device shown in FIG. 1 comprises a feed roller 1 and a feed table 4 mounted to be pivotable about an axle 6 and urged by means of a spring 7 against the feed roller 1, forming a nip line 5. A sliver 3 travels via an inlet funnel 2 into the feeding device and is fed to an opening roller 9, approximately radially with respect thereto. The opening roller 9 is studded, in a way not shown in detail, with a fitting having teeth or needles. The opening roller 9, driven approximately at one thousand times the peripheral speed of the feed roller 1, combs out the sliver 3 with the fitting; the fibers of the sliver still held in the nip line 5 and in the cohesion of the fiber bundle form a fiber tuft 8. The fibers 12 are detached from this fiber tuft 8 and separated, and conveyed via a separation opening 13 along the circumference of the opening roller 9 to a fiber duct 11, where the fibers 12 are discharged and conducted to a spinning rotor or the like.

In the direction of rotation of the opening roller 9, the separation opening 13 is defined, in part, by a wall 14 fashioned as a guide surface conducting the separated impurities 16 to a conveyor belt or the like. In opposition to the direction of rotation of the opening roller 9, the separation opening 13 extends up to the guiding edge 17 of the feed table 4 which faces the opening roller 9. The zone of the separation opening 13 is also bounded by lateral partitions and a boundary wall 15 arranged underneath the feed table 4.

The impurities 16, present between the fibers or also adhering to the fibers are combed out or beaten out of the fiber tuft 8 hanging into the separation opening 13 by means of the fitting of the opening roller 9; these impurities then travel out of the peripheral range of the opening roller 9.

To prevent the sliver 3, fed to the opening roller 9, from flipping away from the opening roller 9, a supporting element is provided in the form of a strip 18. Strip 18 supports the sliver and retains same in the sphere of influence of the fitting of the opening roller 9, wherein almost all fibers of the sliver are still present. This strip 18 is arranged essentially in parallel to the axis of the opening roller 9 and is oriented, with a blade-like edge 20, approximately radially to the axis of the opening roller 9. The strip 18 is curved on its side facing the feed table 4 so that a wedge-shaped inlet is produced between the fitting of the opening roller 9 and the edge 20. The strip 18 is mounted to be adjustable and fixable in position on a pin 19 attached to a wall 23 of the housing 10, which accommodates the opening roller 9 and the feeding device. The strip 18 is arranged at a spacing with respect to the guiding edge 17 of the feed table 4 in such a way that a free space is provided between this guiding edge 17 and the edge 20 of the strip 18, wherein the sliver is not supported. The sliver, penetrated in this zone for the first time by the trimming of the opening roller 9, thus can escape the trimming elements so that the danger of fiber damage due to the relatively very high peripheral velocities of the fitting is reduced. Furthermore, air can enter from the outside in this zone of the sliver, whereby the latter is loosened in this zone. The combing out and beating out of the dirt 16 is not impeded by the strip 18, since the dirt 16 cannot be separated, anyway, until the fiber tuft 8 is thinned out by the detachment of the individual fibers 12, and thus the dirt cannot leave the sliver in the zone of the sliver lying upstream of strip 18, even if the dirt were to be hit by a trimming element.

Figure 2:
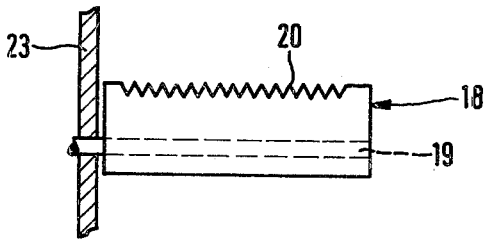
FIG. 2 shows a view in the direction of arrow A of a detail of FIG. 1.

The pin holding the strip 18 is attached to the rear wall 23 of the housing (FIG. 2). In order to provide lateral guidance for the sliver and to ensure that the sliver is not shifted laterally by the trimming elements wound in a spiral onto the opening roller 9, the edge 20 of the strip 18 is equipped with a serrated profiling which can be engaged by the fibers of the sliver so that they are laterally supported by the tooth flanks of the serrated profile.

Figure 3:
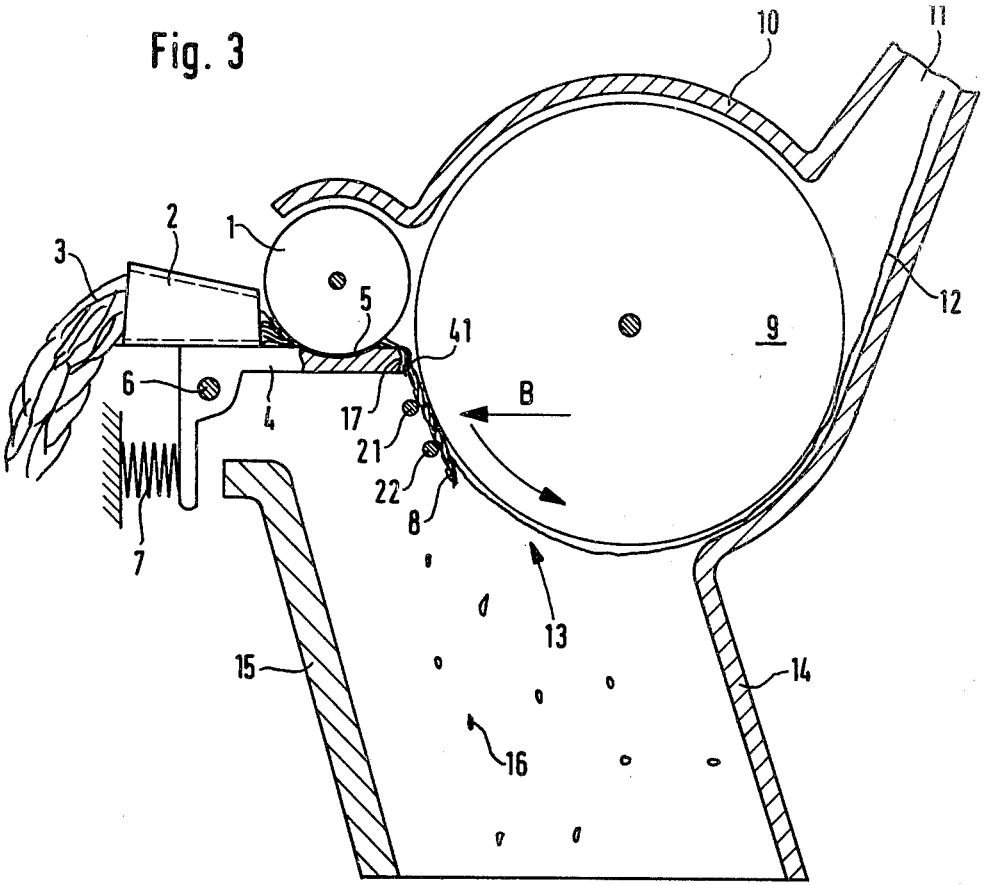
FIG. 3 shows a lateral partial sectional view of another embodiment of a feeding and opening device according to this invention.
Figure 4:
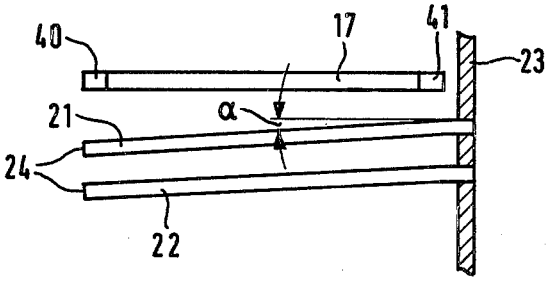
FIG. 4 shows a view of a detail as seen in the direction of arrow B of FIG. 3.

The embodiment of FIGS. 3 and 4 corresponds in its basic structure to the embodiment of FIGS. 1 and 2, and, therefore, elements common thereto bear like reference numerals. Instead of one strip 18, two strips 21 and 22 are provided which are made of a relatively thin rod material of round cross section, said strips being attached to the rear wall 23 of the housing 10. The strip 22 is located approximately at the same spacing from the guiding edge 17 of the feed table 4 as the strip 18 in the embodiment according to FIG. 1. The strip 21 lies between edge 17 and strip 22. Here again, a free space is left between the two supporting elements 21, 22 supporting the sliver and the guiding edge 17; by way of this free space, air can flow in, on the one hand, and the sliver, on the other hand, can escape into this space when the trimming impinges so that damage is prevented. The two strips 21 and 22, located at a small spacing from the periphery of the opening roller 9, are slightly angled with respect to a line parallel to the axis of the opening roller (angle $\alpha$, FIG. 4). As a result, the two strips 21 and 22 have a somewhat larger spacing between them and the guiding edge 17 of the feed table 4 at free ends 24 than in the vicinity of wall 23 at their opposite ends. Due to this slight inclination of the strips 21 and 22, a lateral escape of the sliver can likewise be avoided, especially if the selected inclined position is oriented in opposition to the oblique travel direction or windup direction of the fitting of the opening roller 9.

Figure 5:
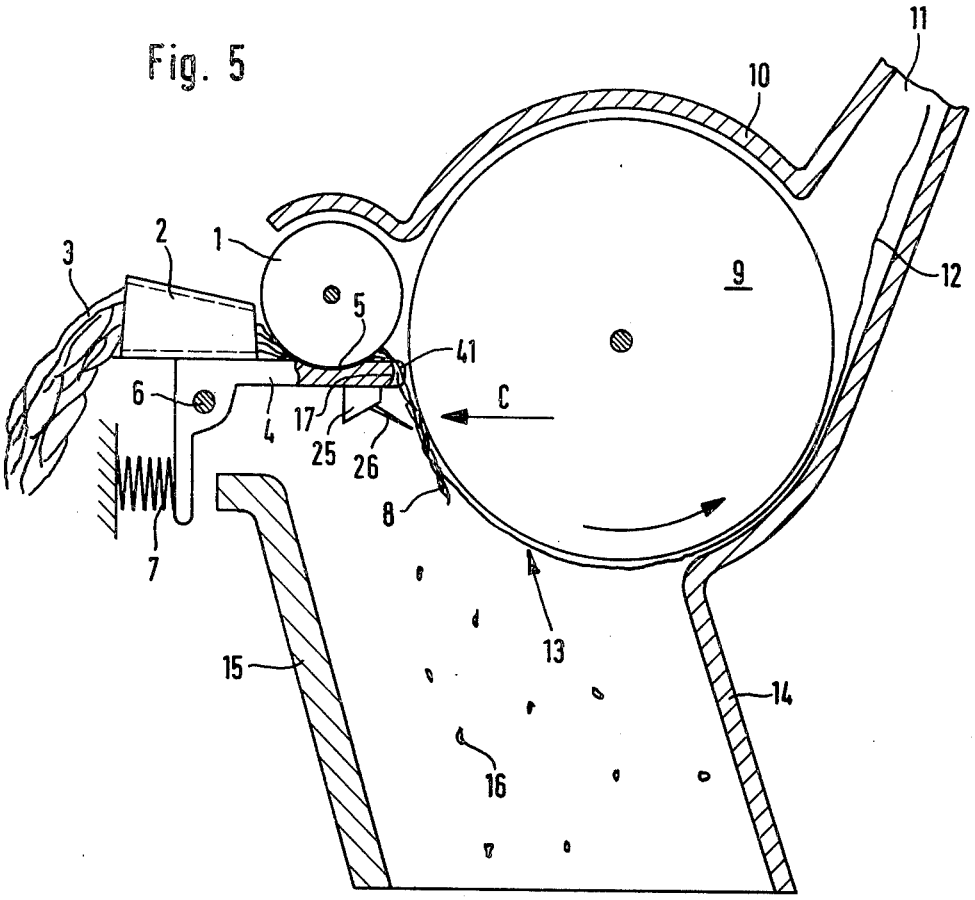
FIG. 5 shows a lateral partial sectional view of a further embodiment of a feeding and opening device according to this invention.
Figure 6:
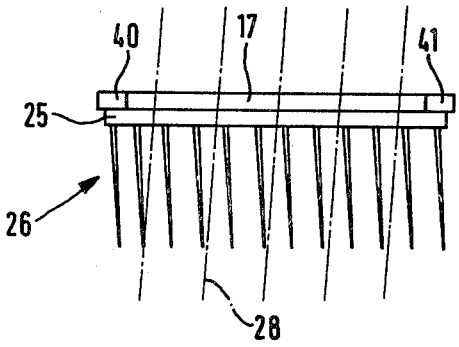
FIG. 6 shows a view in the direction of arrow C of a detail of FIG. 5.

Also, the embodiment of FIGS. 5 and 6 corresponds in its basic structure to the embodiments described above, so that, again, like reference numerals are utilized for common elements. Instead of strip-shaped supporting elements for the sliver, arranged substantially axially parallel to the axis of rotation of the opening roller 9, a row of needles 26 is provided. Needles 26 are attached by a holder 25 to the underside of the feed table 4. The needles 26, with a mutual spacing in the axial direction of the opening roller 9 sufficient to permit penetration of the sliver, are arranged with their mounted ends at a larger distance from the circumference of the opening roller 9 than the distance between the guiding edge 17 and the opening roller 9. In this embodiment, also, a free space is created into which the sliver can escape downstream of the guiding edge 17 so that the danger of fiber damage is reduced.

Although the sliver 3, formed essentially of parallel-oriented fibers, can move into the region between the individual teeth, it has been found that, under practical conditions, the fiber tuft can be held with adequate security in the range of influence of the fitting to permit perfect combing out and separation of the fibers, as well as satisfactory detachment and removal of the impurities 16. It is especially advantageous to orient the needles 26 (FIG. 6) in a slightly inclined position with respect to the planes perpendicular to the axis of rotation of the opening roller 9 and thus with respect to the transport direction of the fibers. In this connection, it is especially advantageous to provide that the inclined orientation of the needles 26 is in opposition to the direction of rotation of the trimming, indicated with dot-dash lines 28 in FIG. 6. As mentioned repeatedly above, fitting made of a sawtooth wire, in particular, is wound spirally onto the opening roller 9 so that this fitting combs through the sliver, offered to the opening roller 9, in an oblique direction. By the oblique orientation of the needles 26 against the travel direction of the fitting elements, as especially satisfactory combing out action is achieved and thus good cleaning and separation are provided. Since the needles 26 maintain between them a relatively large spacing, they can project even into the region of the fiber tuft 8 without impeding appreciably the flying away of the combed-out or beaten-out dirt, since the latter can fly out through the interspaces existing between the needles 26.

Figure 7:
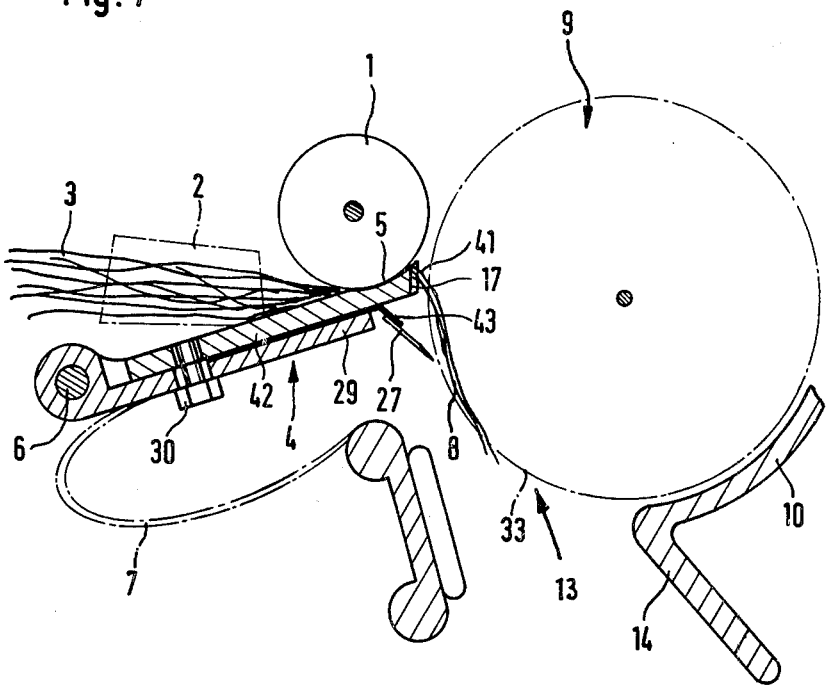
FIG. 7 shows a schematic illustration of parts of a feeding and opening device according to the invention, without a housing accommodating the device.

Also, the embodiment of FIG. 7 corresponds essentially to the embodiments described hereinabove. The housing 10, accommodating the feeding and opening device, is shown only in part. Here again, a zone of about 90° is provided between the feed table 4 and the wall 14, delimiting the separation opening 13 in the peripheral direction, so that the separation opening 13 occupies, as in all other embodiments, a quarter of the circumference of the opening roller 9, also in this case.

However, in contrast to the previous embodiments, a feed table 4' is provided which comprises a plate-like holder 29, which is mounted to be pivotable about an axle 6; this holder is constructed, for example, as a pressure die-cast aluminum article, a plate 42 being attached by means of a screw 30 to the topside of this holder. The plate 42 is made of steel, for example, and has a polished and chrome-plated surface at least in the zone coming into contact with the fibers. This plate 42 has a trough 39, upon its upper surface, near its end facing the opening roller 9, the radius of this trough being slightly larger than the radius of the feed roller 1. The feed table 4 is urged against the feed roller 1 by means of a leaf spring 7' (shown only in dashed lines), so that the size nip 5, between trough 39 and roller is adjustably controlled by spring 7'. The guiding edge 17, the transition of which is rounded toward the trough 39, maintains a larger spacing to the tips of the fitting 33 of the opening roller 9. A sheet 43 is clamped in between the holder 29 and the plate 42, a row of needles 27 being arranged on this sheet on an angled edge thereof. The angled edge of sheet 43 is further from the circumference of the opening roller 9 than the guiding edge 17. The needles 27 point with their tips obliquely relative to the fitting 33 of the opening roller 9. The needles 27 are adjusted so that their tips keep a spacing of 0.5 to 1 mm from the fitting 33. The distance of the tips of needles 27 from the guiding edge 17 is about 15 mm so that the tips of the needles 27, when processing cotton with a customary fiber length of about 30 mm, are within an area wherein the fiber tuft 8 has, as yet, practically not broken up at all, i.e., only a very few individual fibers have as yet been pulled out.

Figure 10:
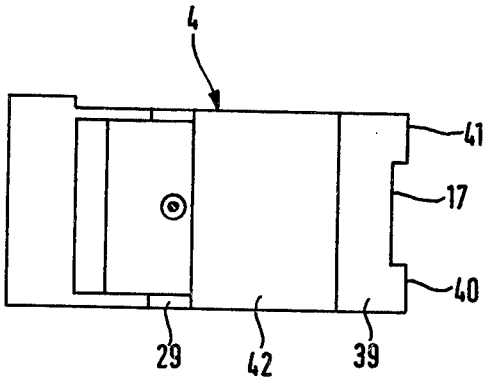
FIG. 10 shows a top view of a feed table.

The feed table 4 guides, with its guiding edge 17, the width of which is limited by collars 40 and 41 (FIG. 10), the sliver into the fitting 33 of the opening roller 9. Since the sliver is not supported in the conveying direction directly downstream of the guiding edge 17, the sliver can yield backwards when engaging the fitting 33 so that the sliver is not pinched between the tips of the fitting and a supporting surface or the like. This considerably reduces the danger of fiber damage. The needles 27, supporting the fiber tuft 8 at a spacing after the guiding edge 17, however, securely prevent the fiber tuft 8 from moving in its entirety out of the fitting 33. Since the stability of the individual fibers in the fiber tuft 8 (which has, at this point, only very slightly separated) is still relatively high on account of the remaining fibers, the spot-wise support by the needle tips is adequate for maintaining the fiber tuft 8 as a whole in the area of effectiveness of the fitting 33 of the opening roller 9, and for the prevention of fluttering, particularly in the region where opening up of the individual fibers commences with greater vigor. Above all, an escape of the fiber tuft 8 in the axial direction of the opening roller 9 is also prevented.

Figure 8:
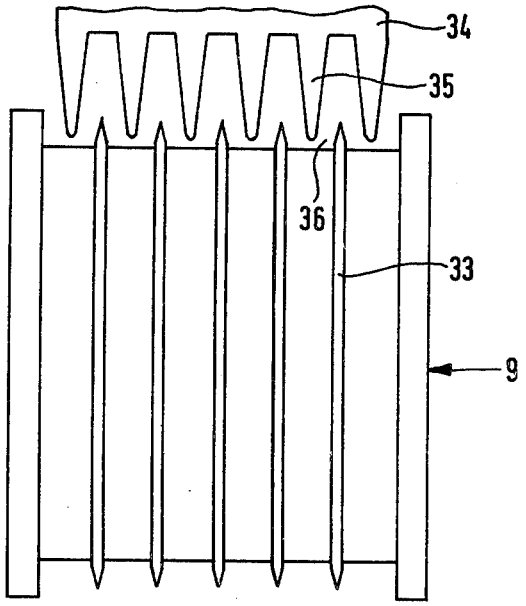
FIG. 8 shows a schematic view of a supporting device for the sliver with a specific structure for the trimming of an opening roller.

In the fragmentary view of another feeding and opening device shown in FIG. 8, a strip with projections in the form of a toothed comb 34 is provided as the supporting element for the fiber tuft, and is spaced from a guiding edge of a feed table, which guiding edge is not illustrated. This comb has relatively pointed teeth 35, which are oriented toward the circumference of the opening roller 9, and are arranged in the conveying direction at a distance from the guiding edge. In this connection, the provision is made that the fitting elements 33 of the opening roller 9 are located in planes lying perpendicularly to the axis of rotation of the opening roller 9 so that the teeth 35 of the toothed comb 34 can engage in the fitting gaps 36 provided between the fitting elements 33.

Figure 9:
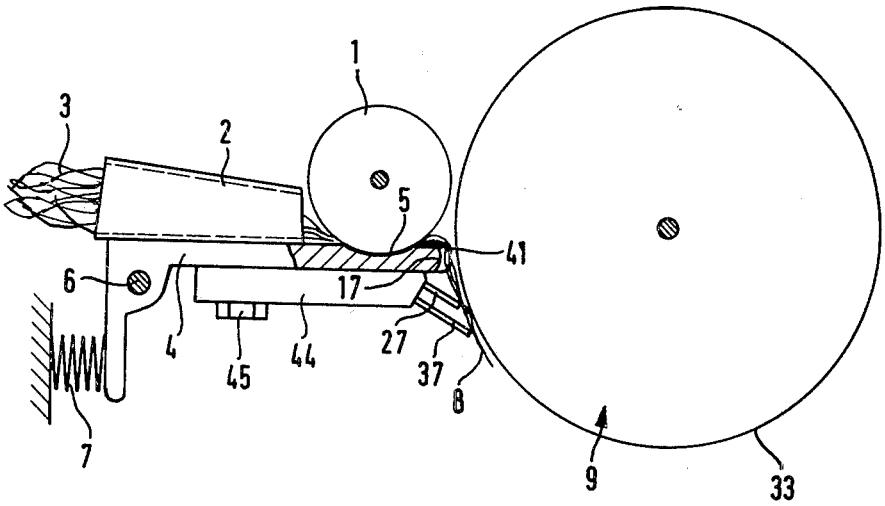
FIG. 9 shows a lateral partial sectional view of another embodiment with a double needle row.

In the embodiment of FIG. 9, initially corresponding in its basic structure to the embodiment of FIG. 5, a holder 44 is attached by means of a screw 45 on the underside of the feed table 4. This holder is equipped underneath the guiding edge 17 of the feed table 4 with two rows of needles 27 and 37, which serve as supporting elements for the fiber tuft 8 offered to the fitting 33 of the opening roller 9; the opening roller 9, corresponding to that of the embodiment of FIG. 5, is surrounded by a housing, not shown. The tips of the needles 27 and 37 extend relatively closely to the periphery of the fitting 33, and are both located at a marked distance, in the conveying direction of the fibers, downstream of the guiding edge 17, which latter maintains a relatively large distance from the fitting 33 of the opening roller 9. They point into the region of the fiber tuft 8, wherein the actual opening process begins, i.e., to the end of the feeding points of the sliver. To securely hold the fiber tuft 8 in the zone of the fitting 33, the tips of the needles 27, 37 must be in a region wherein the sliver is still present almost in its entirety.

In a modification of the embodiment of FIG. 9, the provision can also be made to arrange the tips of needles 27 and 37 inclined with respect to each other, rather than mutually in parallel, so that they are oriented toward a common generatrix of the fitting 33. In a manner not shown in detail, the spacing of the tips of the needles 27 and 37, with respect to the fitting 33, can be made adjustable in correspondence with the fiber material to be processed, for example, by the provision of a slotted hole in the holder 44. Furthermore, the additional provision can be made, in a way not illustrated in detail, that also the inclination of the needles 27 and 37, with respect to the circumference of the fitting 33 and/or their spacing with respect to the guiding edge 17 of the feed table, can be adjusted.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A feeding and opening device for open-end spinning units, comprising a feeding roller and a feed table resiliently urged against the feeding roller for feeding a sliver to an opening roller that is rotatable about an axis, a separation opening for impurities removed from the sliver arranged in the peripheral region of the opening roller, the separation opening extending from a guiding edge of the feed table to a guide surface for conduting away said impurities, and a supporting means for supporting the sliver with respect to the opening roller in the zone of the separation opening, the supporting means including at least one mechanical supporting element located at a spacing from the guide edge of the feed table while leaving a free space that is open toward the atmosphere therebetween, and the supporting element having at least one strip located, at a spacing from the guiding edge of the feed table, essentially in parallel to the axis of the opening roller.

2. Device according to claim 1, wherein the strip has a blade-like edge directed toward the circumference of the opening roller.

3. Device according to claim 2 wherein the blade-like edge is equipped with a tooth-like profiling.

4. Device according to claims 2 or 3, wherein a surface of the strip facing the feed table has a curvature which extends to the blade-like edge.

5. Device according to claim 1, wherein at least one strip that is round in cross section is provided as the supporting element.

6. Device according to claim 5, wherein said at least one strip is arranged slightly inclined with respect to the conveying direction of the sliver.

7. Device according to claim 6, wherein said inclination of the strip is oriented in opposition to a direction in which a fitting is wound onto the opening roller.

8. Device according to claims 1 or 2 or 3, wherein at least one strip that is round in cross section is provided as the supporting element.

9. Device according to claim 8, wherein said at least one strip is arranged slightly inclined with respect to the conveying direction of the sliver.

10. Device according to claim 1, wherein the supporting element comprises at least one row of needles which are held at an end downstream of the guiding edge of the feed table in the conveying direction of the sliver, and wherein the held end of the needles have a larger radial spacing with respect to the circumference of the opening roller than the guiding edge of the feed table.

11. Device according to claim 10, wherein the needles are oriented obliquely toward planes located perpendicularly to the axis of rotation of the opening roller.

12. Device according to claim 11, wherein the oblique orientation of the needles is in opposition to the direction in which a fitting is wound onto the opening roller.

13. Device according to claim 10 or 11 or 12, wherein the needles are held by means of a holder in such a way that the spacing of the needles relative to the circumference of the opening roller is adjustable.

14. Device according to claim 13, wherein the needles are held by means of a holder in such a way that the angle at which they are oriented with respect to the circumference of the opening roller is adjustable.

15. Device according to claims 10 or 11 or 12, wherein the needles are held by means of a holder in such a way that the angle at which they are oriented with respect to the circumference of the opening roller is adjustable.

16. Device according to claims 10 or 11 or 12, wherein the needles project into gaps located between fitting elements of the opening roller.

17. Device according to claim 16, wherein the needles taper in a direction toward the fitting of the opening roller.

18. Device according to claim 2, wherein the supporting element comprises a strip with projections in the form of a toothed comb.

19. Device according to claim 18, wherein the projections project into gaps located between fitting elements of the opening roller.

20. Device according to claim 19, wherein the projections taper in a direction toward the fitting of the opening roller.

* * * * *